United States Patent [19]

Luenser

[11] 4,349,116

[45] Sep. 14, 1982

[54] THERMOPLASTIC SCREW-THREADED CLOSURE CAP

[75] Inventor: Werner R. Luenser, Blue Island, Ill.

[73] Assignee: Ethyl Products Company, Richmond, Va.

[21] Appl. No.: 60,743

[22] Filed: Jul. 25, 1979

Related U.S. Application Data

[63] Continuation of Ser. No. 967,493, Dec. 7, 1978, abandoned.

[51] Int. Cl.[3] ..... B65D 41/04

[52] U.S. Cl. ..... 215/330; 220/289

[58] Field of Search ..... 215/330, 216; 220/289; 151/7

[56] References Cited

U.S. PATENT DOCUMENTS

| | | | |
|---|---|---|---|
| 3,463,340 | 8/1969 | Lindstrom | 215/330 |
| 3,480,170 | 11/1969 | Evans | 215/330 X |
| 4,125,201 | 11/1978 | Birch | 215/330 |

*Primary Examiner*—Donald F. Norton

*Attorney, Agent, or Firm*—Donald L. Johnson; John F. Sieberth; Edgar E. Spielman, Jr.

[57] ABSTRACT

A thermoplastic cap having improved anti-backoff characteristics features a primary helical thread and a coaxial secondary thread. The cap is of a thermoplastic material having an elastic modulus in flexure within the range of from about $0.2\times10^5$ to about $10^6$ pounds per square inch so that the secondary helical thread will flex in response to tightening torque.

13 Claims, 5 Drawing Figures

THERMOPLASTIC SCREW-THREADED CLOSURE CAP

This is a continuation of application Ser. No. 967,493 filed Dec. 7, 1978, now abandoned.

BACKGROUND OF THE INVENTION

There is a rapidly increasing trend towards the use of linerless thermoplastic closures for both glass and plastic bottles. The linerless closure is less expensive than a lined plastic closure and is expected to be less expensive than metal closures which have high energy requirements for their production. The linerless closure is also able to provide a high fidelity seal which makes it an excellent candidate for use in packaging food and beverages. This market is growing at a rapid rate and is expected to have a volume potential so great that it would be presumptious to attempt to project the volume in the next few years.

Due to the short skirts which are characteristic of today's caps, the greatest problem impeding the use of linerless closures is that the short skirts do not provide sufficient surface area for cap thread and bottle thread contact. Insufficiency in thread contact results in the closure backing off and loosening from the bottle as time elapses and as the package is sent through commerce. A system described in U.S. Pat. No. 3,480,170 provides some anti-backoff characteristics by increasing the radial interference between the cap and bottle finish. However, this system is of a fairly complex nature.

It is therefore an object of this invention to provide a thermoplastic closure which exhibits high anti-backoff characteristics and which is simple in construction. It is also another object of this invention to provide a linerless thermoplastic cap having high anti-backoff characteristics.

The Invention

This invention relates to a thermoplastic cap having an elastic modulus in flexure within the range of from about $0.2\times10^5$ to about $10^6$ per pounds per square inch and comprising: a top wall; an annular sidewall integrally formed with and downwardly depending from the top wall; an inwardly extending primary helical thread about the inside surface of the sidewall for cooperation with a container helical thread; and an inwardly extending secondary helical thread (i) about the inside surface of the sidewall, (ii) coaxial with the primary thread, (iii) displaced upwardly within the range of from about 0.010 to about 0.030 inches above the primary thread, (iv) having a vertical width within the range of from about 0.010 to about 0.030 inches, and (v) having a horizontal width within the range of from about 0.015 to about 0.035 inches.

The primary thread is a conventional cap thread dimensioned to hold the cap to the container when the primary thread engages the container thread. This dimensioning is well-known to those skilled in the art.

Since the secondary thread is displaced upwardly from the primary thread and coaxial with the primary thread, the secondary thread will make contact with the container thread thus adding its surface contact to the conventional surface contact of the primary thread with the container thread. By having this additional surface contact, the anti-backoff feature of the thermoplastic cap of this invention is made possible. Also the cap of this invention has an elastic modulus in flexure such that the secondary thread will slightly deform as the cap is tightened to the container. This deformation also adds to the desirable anti-backoff characteristic which is featured by the cap.

The above-described cap can be made by any conventional injection molding technique which is well-known for producing closure caps. Exemplary of materials of which the cap of this invention can be made are polypropylene, polyethylene, polyvinyl chloride, nylon, etc. Of these materials it has been found that polypropylene and polyethylene give highly desirable results at low cost.

These and other features of this invention contributing to economy in manufacture and satisfaction in use will be more fully understood from the following description of a preferred embodiment of the invention when taken in connection with the accompanying drawings wherein identical numerals refer to identical parts and in which.

Figure 2:
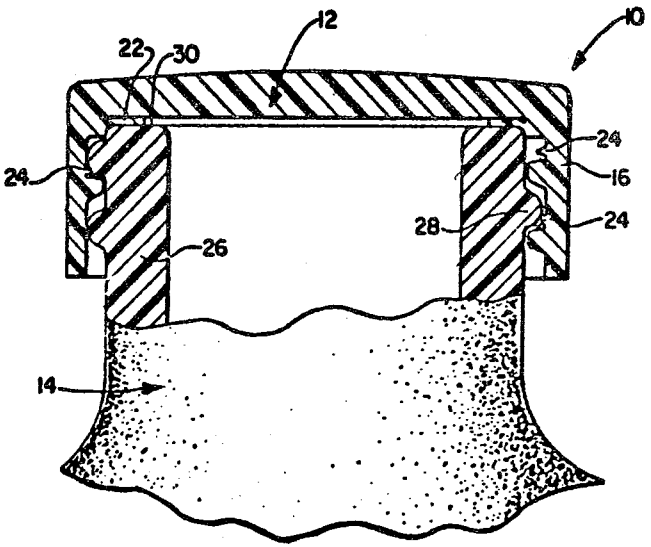
FIG. 2 is an elevational, partially broken, vertical sectional view of the package shown in FIG. 1 with the cap tightened to the container.
Figure 1:
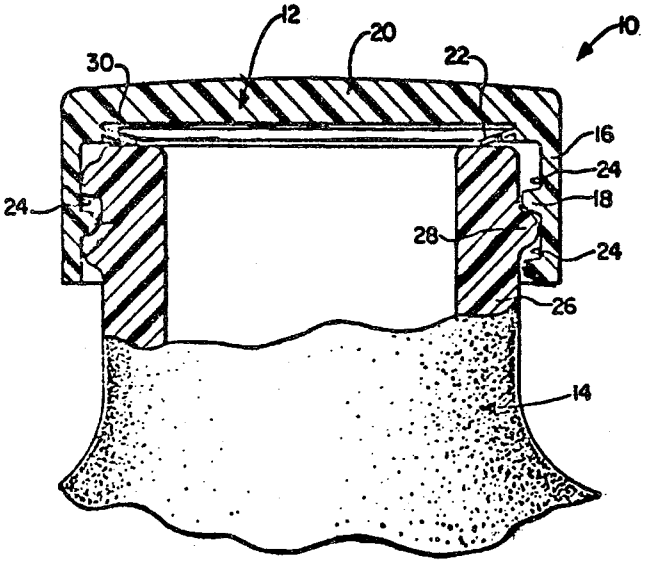
FIG. 1 is an elevational, partially broken, vertical sectional view of a package utilizing the cap of this invention with the cap not tightened to the container.

Referring now to FIGS. 1 and 2, it can be seen that a package, generally designated by the numeral 10, has a cap, generally designated by the numeral 12, affixed to a container, generally designated by the numeral 14. Container 14 may be either glass or of a thermoplastic material such as polyethylene, polypropylene, polyvinyl chloride, etc. Container 14 has about its neck helical thread 28. At the uppermost extent of the neck of container 14 there is provided a relatively flat rim area 30.

Figure 4:
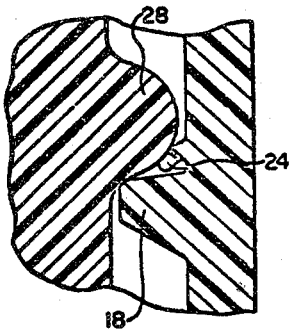
FIG. 4 is an enlarged detail view showing the primary and secondary threads of the cap shown in FIG. 3.

Cap 12 has a top wall 20 which is circular in shape. Top wall 20 has downwardly depending therefrom cap sidewall 16. On the inside surface of cap sidewall 16 there is primary helical thread 18 which extends inwardly from the inside face of sidewall 16. As beforementioned, primary thread 18 is a conventional cap thread. Displaced upwardly from primary thread 18 and coaxial therewith is secondary thread 24. The upward displacement of secondary thread 24 is within the range of from about 0.010 to about 0.030 inches. This upward displacement is necessary so that secondary thread 24 will be able to make contact with closure thread 28 above the contact made by the primary thread as depicted in FIG. 4. Since secondary thread 24 achieves this contact with container thread 28, additional surface area of contact between the cap threads and the container thread is achieved thereby contributing to the anti-backoff feature of the cap of this invention.

Figure 3:
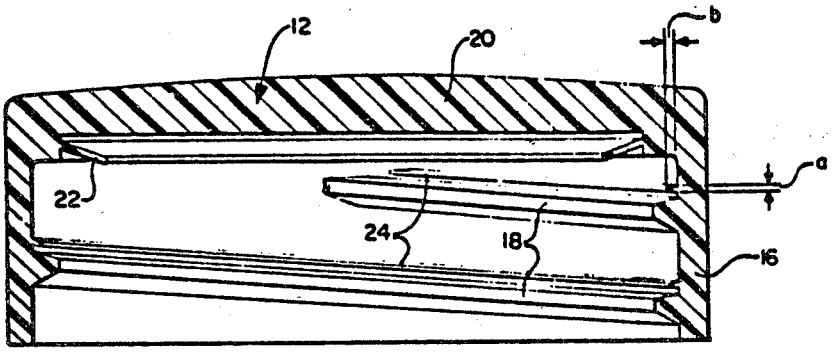
FIG. 3 is a vertical sectional view of the cap shown in FIG. 1.

Secondary thread 24 is dimensioned considerably smaller than primary thread 18. It has been found that secondary thread 24 should have a vertical thickness within the range of from about 0.010 to about 0.035 inches and a horizontal thickness within the range of from about 0.015 to about 0.035 inches. When using polypropylene or polyethylene a preferred vertical thickness will be within the range of from about 0.015 to about 0.020 inches and a preferred horizontal thickness will be within the range of from about 0.020 to about 0.025 inches. The vertical width is shown as measurement "b" in FIG. 3 while the horizontal width is shown as measurement "a". With this size secondary thread and with the flexibility of the thermoplastic material of manufacture, it is insured that the secondary thread will flex as is shown in FIG. 4.

To insure the slight flexing of secondary thread 24 as shown in FIG. 4, it has been found necessary that cap 12 be made of a thermoplastic material having an elastic modulus in flexure within the range of from about $0.20\times10^5$ to about $10^6$ pounds per square inch. The previously mentioned materials from which cap 12 can be made all exhibit such an elastic modulus in flexure. However, thermoplastic materials other than the specific ones named previously may be utilized as long as their elastic modulus in flexure is within the previously described range. It has been found preferable that the elastic modulus in flexure be within the range of from about $1\times10^5$ to about $5\times10^5$ pounds per square inch. The preferred materials, i.e. polypropylene and polyethylene, will provide such an elastic modulus in flexure.

Figure 5:
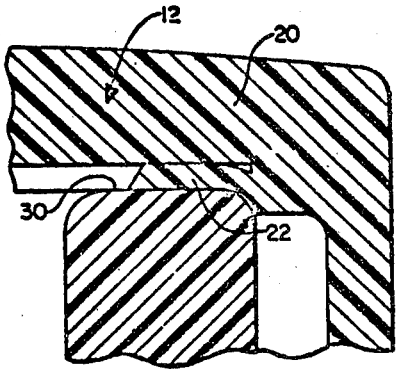
FIG. 5 is an enlarged detail view showing the sealing fin of the cap shown in FIG. 3.

Adjacent the intersection of top wall 20 and downwardly depending sidewall 16 of cap 12 there is provided (see FIG. 3) an inwardly and downwardly extending sealing fin 22. As is shown in FIGS. 2 and 5, sealing fin 22 contacts container rim 30 and is pressed upwardly towards cap top 20. This upward depressing of sealing fin 22 by container rim 30 when cap 12 is attached to container 14 provides a liquid-tight seal which prevents leakage of the package contents. While the sealing fin shown in the drawings is preferred, it is to be understood that the cap of this invention can have different topes of linerless sealing systems. Other systems which may be utilized with the anti-backoff feature of this invention are, for example, the systems described in U.S. Pat. Nos. 3,784,041, 3,814,274, 3,815,771, 3,888,378, 3,038,624 and 3,203,571. It is also possible, and in many instances desirable, to utilize the anti-backoff feature of this invention with caps utilizing conventional liners. These conventional linered caps will benefit in the same manner as linerless closures, i.e. they will have the tendency to maintain, to a high degree, the original tightening torque even after a lapse of time.

To test the fidelity of the before-described anti-backoff feature, a series of tests were run with a cap of this invention and compared against an identical series of tests run with a conventional cap having a single primary thread. These results are summarized below in the following tables.

TABLE I

Cap Material: Polypropylene
Package Contents: 50% $H_2O$, 50% Ethyl Alcohol

| Container No. | Test Period | Torque On Inch/Pound | Torque Off Inch/Pound |
|---|---|---|---|
| 149 | 1 wk. | 25.0 | 12.5 |
| 150 | 1 wk. | 25.0 | 10.5 |
| 151 | 1 wk. | 25.0 | 9.5 |
| 152 | 1 wk. | 25.0 | 13.0 |
| 153 | 1 wk. | 25.0 | 12.5 |
| 154 | 1 wk. | 25.0 | 14.0 |
| 155 | 2 wk. | 25.0 | 10.0 |
| 156 | 2 wk. | 25.0 | 10.5 |
| 157 | 2 wk. | 25.0 | 10.5 |
| 158 | 2 wk. | 25.0 | 10.5 |
| 159 | 2 wk. | 25.0 | 10.0 |
| 160 | 2 wk. | 25.0 | 10.0 |

TABLE I-continued

Cap Material: Polypropylene
Package Contents: 50% $H_2O$, 50% Ethyl Alcohol

| Container No. | Test Period | Torque On Inch/Pound | Torque Off Inch/Pound |
|---|---|---|---|
| 161 | 3 wk. | 25.0 | 5.0 |
| 162 | 3 wk. | 25.0 | 12.0 |
| 163 | 3 wk. | 25.0 | 11.0 |
| 164 | 3 wk. | 25.0 | * |
| 165 | 3 wk. | 25.0 | 12.0 |
| 166 | 3 wk. | 25.0 | * |
| 164 | 4 wk. | 25.0 | 13.5 |
| 168 | 4 wk. | 25.0 | 11.0 |
| 169 | 4 wk. | 25.0 | 9.5 |
| 170 | 4 wk. | 25.0 | 12.0 |
| 171 | 4 wk. | 25.0 | 18.5 |
| 172 | 4 wk. | 25.0 | 18.0 |

*Container broken during handling.

As can be seen from Table I, the four week total average in inch/pounds for removal torque is approximately 12.0 inch/pounds.

Identical tests were run utilizing containers of the same design and containing the same product. The polypropylene closure did not have the anti-backoff feature of this invention but rather had the conventional single primary thread.

TABLE II

Cap Material: Polypropylene
Package Contents: 50% $H_2O$, 50% Ethyl Alcohol

| Container No. | Test Period | Torque On Inch/Pound | Torque Off Inch/Pound |
|---|---|---|---|
| 119 | 1 wk. | 25.0 | 7.0 |
| 120 | 1 wk. | 25.0 | 7.0 |
| 121 | 1 wk. | 25.0 | 6.5 |
| 122 | 1 wk. | 25.0 | 8.0 |
| 123 | 1 wk. | 25.0 | 5.5 |
| 124 | 1 wk. | 25.0 | 6.0 |
| 113 | 2 wk. | 25.0 | 4.0 |
| 114 | 2 wk. | 25.0 | 5.0 |
| 115 | 2 wk. | 25.0 | 5.0 |
| 116 | 2 wk. | 25.0 | 8.5 |
| 117 | 2 wk. | 25.0 | 5.0 |
| 118 | 2 wk. | 25.0 | 6.5 |
| 107 | 3 wk. | 25.0 | 4.5 |
| 108 | 3 wk. | 25.0 | 4.0 |
| 109 | 3 wk. | 25.0 | 4.5 |
| 110 | 3 wk. | 25.0 | 5.0 |
| 111 | 3 wk. | 25.0 | 4.5 |
| 112 | 3 wk. | 25.0 | 6.0 |
| 101 | 4 wk. | 25.0 | 6.5 |
| 102 | 4 wk. | 25.0 | 7.5 |
| 103 | 4 wk. | 25.0 | 9.5 |
| 104 | 4 wk. | 25.0 | 9.0 |
| 105 | 4 wk. | 25.0 | 11.0 |
| 106 | 4 wk. | 25.0 | 7.0 |

Averaging the off-torque in inch/pounds for the four week period, it was found that the conventional cap exhibited only 6.38 inch/pound to remove the cap from the container.

Comparing the four week averages of the removal torque between the conventional cap and the cap of this invention, it can be appreciated that the cap of this invention retains almost twice the removal torque of that exhibited by the conventional cap.

What is claimed is:

1. A thermoplastic cap having an elastic modulus in flexure within the range of from about $0.2\times10^5$ to about $10^6$ pounds per square inch and comprising:

a. a top wall;

b. an annular sidewall integrally formed with and downwardly depending from the top wall;

c. an inwardly extending primary helical thread about the inside surface of said sidewall for cooperation with a container helical thread; and d. an inwardly extending secondary helical thread
   i. about the inside surface of said sidewall,
   ii. coaxial with said primary thread,
   iii. displaced upwardly within the range of from about 0.010 to about 0.030 inches above said primary thread,
   iv. having a vertical width within the range of from about 0.010 to about 0.030 inches, and
   v. having a horizontal width within the range of from about 0.015 to about 0.035 inches.

2. The cap of claim 1 wherein said top wall is circular.

3. The cap of claim 1 wherein said elastic modulus in flexure is within the range of from about $1\times10^5$ to about $5\times10^5$ pounds per square inch.

4. The cap of claim 1 wherein said cap is of polypropylene.

5. The cap of claim 4 wherein said vertical width is within the range of from about 0.015 to about 0.020 inches, and wherein said horizontal width is within the range of from about 0.020 to about 0.025 inches.

6. The cap of claim 1 wherein said cap is of polyethylene.

7. The cap of claim 6 wherein said vertical width is within the range of from about 0.015 to about 0.020 inches, and wherein said horizontal width is within the range of from about 0.020 to about 0.025 inches.

8. A thermoplastic cap comprising:

a. a top wall;

b. an annular sidewall integrally formed and downwardly depending from said top wall;

c. an inwardly extending primary helical thread about the inside surface of said sidewall for cooperation with a container helical thread; and d. an inwardly extending secondary helical thread,
   i. about the inside surface of said sidewall,
   ii. coaxial with said primary thread,
   iii. having a horizontal and vertical width less than the horizontal and vertical width of said primary thread,
   iv. displaced upwardly above said primary thread whereby said secondary thread comes into resilient engagement with the underside of the container helical thread when said cap is screwed to the container, said engagement affecting resistance to loosening of the cap from the container.

9. The cap of claim 8 wherein said top wall is circular.

10. The cap of claim 8 wherein said cap has an elastic modulus in flexure within a range of from about $0.2\times10^5$ to about $0.2\times10^6$ pounds per square inch.

11. The cap of claim 10 wherein said elastic modulus in flexure is within the range of from about $1\times10^5$ to about $5\times10^5$ pounds per square inch.

12. The cap of claim 8 wherein said cap is polypropylene.

13. The cap of claim 8 wherein said cap is polyethylene.

* * * * *